US010472691B2

(12) United States Patent
Köyer et al.

(10) Patent No.: US 10,472,691 B2
(45) Date of Patent: Nov. 12, 2019

(54) HOT-FORMING APPARATUS AND METHOD FOR PRODUCING PRESS-HARDENED SHAPED COMPONENTS FROM STEEL SHEET

(71) Applicants: THYSSENKRUPP STEEL EUROPE AG, Duisburg (DE); THYSSENKRUPP AG, Essen (DE)

(72) Inventors: Maria Köyer, Dortmund (DE); Sascha Sikora, Lünen (DE); Janko Banik, Altena (DE)

(73) Assignees: THYSSENKRUPP AG, Essen (DE); THYSSENKRUPP STEEL EUROPE AG, Duisburg (DE)

( * ) Notice: Subject to any disclaimer, the term of this patent is extended or adjusted under 35 U.S.C. 154(b) by 650 days.

(21) Appl. No.: 14/823,657

(22) Filed: Aug. 11, 2015

(65) Prior Publication Data

US 2016/0047010 A1 Feb. 18, 2016

(30) Foreign Application Priority Data

Aug. 12, 2014 (DE) ..... 10 2014 111 501

(51) Int. Cl.
*C21D 8/00* (2006.01)
*C21D 1/18* (2006.01)
(Continued)

(52) U.S. Cl.
CPC ..... *C21D 8/005* (2013.01); *C21D 1/18* (2013.01); *B21B 27/106* (2013.01); *B21B 2015/0071* (2013.01); *B21B 2027/086* (2013.01)

(58) Field of Classification Search
CPC ..... B21B 1/227; B21B 2015/0071; B21B 27/005; B21B 27/106; B21B 2027/086; C21D 1/673; B21D 22/022
(Continued)

(56) References Cited

U.S. PATENT DOCUMENTS 2,972,472 A * 2/1961 Reynolds ..... B29B 7/625 165/133
5,508,119 A * 4/1996 Sheu ..... B21B 1/227 219/121.67
(Continued)

FOREIGN PATENT DOCUMENTS

CN 101346196 A 1/2009
CN 102039349 A 5/2011
(Continued)

OTHER PUBLICATIONS

Machine Translation of JP05-295422, Translated Apr. 3, 2019, 3 Pages. (Year: 1993).*
(Continued)

*Primary Examiner* — Gregory D Swiatocha
(74) *Attorney, Agent, or Firm* — Lathrop Gage L.L.P.

(57) ABSTRACT

A hot-forming apparatus may be used to produce a press-hardened shaped component from a blank. The hot-forming apparatus may include a furnace for heating the blank and a pressing device for forming and cooling the blank heated in the furnace. The hot-forming apparatus also includes, upstream of the furnace, a preheating roll truing device with a temperature-controllable roller for straightening and preheating the blank. A corresponding method may be used to produce the press-hardened shaped component from the blank.

11 Claims, 1 Drawing Sheet

(51) Int. Cl.

| | |
|---|---|
| ***B21B 27/10*** | (2006.01) |
| ***B21B 27/08*** | (2006.01) |
| ***B21B 15/00*** | (2006.01) |

(58) Field of Classification Search
USPC ..... 219/81–84, 244, 469, 619
See application file for complete search history.

(56) References Cited

U.S. PATENT DOCUMENTS

| | | | | |
|---|---|---|---|---|
| 6,327,883 | B1 * | 12/2001 | Noe | B21B 37/32 72/12.2 |
| 2002/0029870 | A1 * | 3/2002 | Schweinichen | D21G 1/0266 165/90 |
| 2008/0093049 | A1 * | 4/2008 | Seidel | B21B 1/46 164/463 |
| 2011/0094282 | A1 | 4/2011 | Overrath et al. | |
| 2013/0104616 | A1 | 5/2013 | Masek et al. | |
| 2013/0273389 | A1 * | 10/2013 | Kaneko | C09D 5/084 428/626 |
| 2013/0312478 | A1 | 11/2013 | Kobayashi | |
| 2015/0225830 | A1 * | 8/2015 | Nonaka | C22C 38/001 428/653 |

FOREIGN PATENT DOCUMENTS

| | | | | |
|---|---|---|---|---|
| CN | 102248330 | A | | 11/2011 |
| CN | 102794333 | A | | 11/2012 |
| CN | 202555625 | U | | 11/2012 |
| CN | 202782093 | U | | 3/2013 |
| CN | 103128151 | A | | 6/2013 |
| CN | 103447366 | A | | 12/2013 |
| CN | 103551425 | A | | 2/2014 |
| DE | 102010055148 | A1 | | 6/2012 |
| DE | 102013100682 | B3 | | 6/2014 |
| EP | 2233593 | A2 | | 9/2010 |
| JP | 5295422 | A | * | 11/1993 |
| JP | H05295422 | A | | 11/1993 |
| JP | 2012166232 | A | | 9/2012 |

OTHER PUBLICATIONS

English language Abstract for DE 10 2013 100 682 B3 listed above.
English language Abstract for DE 10 2010 055 148 A1 listed above.
English language Abstract for CN 101346196 A listed above.
English language Abstract for JP 2012166232 A listed above.
English language Abstract for CN 102794333 A listed above.
English language Abstract for CN 103551425 A listed above.
English Abstract of EP 2233593 (A2).

* cited by examiner

HOT-FORMING APPARATUS AND METHOD FOR PRODUCING PRESS-HARDENED SHAPED COMPONENTS FROM STEEL SHEET

CROSS-REFERENCE TO RELATED APPLICATIONS

This application claims foreign priority to prior filed German Patent Application Serial No. DE 102014111501.5 filed Aug. 12, 2014, the entire contents of which is hereby incorporated by reference herein.

FIELD

This disclosure relates to a hot-forming apparatus for producing a press-hardened shaped component from a blank, with a furnace for heating the blank and a pressing device for forming and cooling the blank heated in the furnace. The invention further relates to a method for producing a press-hardened shaped component from a blank, wherein the blank is heated in a furnace and the heated blank is formed and cooled in a pressing device.

BACKGROUND

Hot-forming apparatuses for producing a press-hardened shaped component from a blank may be used, for example, to produce press-hardened shaped components for automobiles, such as vehicle doors, side-impact supports, a-pillars, or b-pillars.

As the starting material for producing such shaped components, use is commonly made of steel sheet in the form of what are termed metal blanks which are cut from a coil. The blanks are first heated in a furnace, usually in a continuous furnace, up to the austenitizing temperature of the steel, such that the lattice structure of the steel changes. Then, the heated blanks are fed to a pressing device in which the blanks are shaped. The pressing device generally has a cooling device such that the shaped material can be quickly cooled in the press. The rapid cooling causes the formation, in the shaped component, of a martensitic structure, which causes a hardening the shaped component.

Such a hot-forming apparatus is known for example from EP 2 233 593 B1. This hot-forming apparatus has a preheating device which preheats the steel sheet to an elevated temperature before it is fed to the furnace. For preheating, two heating plates are brought into contact with the steel sheet from above and from below. The heating plates are removed from the steel sheet, such that the latter can be introduced into the furnace.

The known apparatus has proven useful in practice. However, it has been observed that the blanks cut from the coil often have undesired deformations or unevennesses which worsen as a consequence of the heating in the furnace. The deformed blanks cannot be reworked and are obtained as rejects. With respect to the economic viability of such hot-forming apparatuses, it is however desirable to reduce the reject rate and to permit a higher-rate method sequence.

BRIEF DESCRIPTION OF THE DRAWINGS

The present invention is described in detail below with reference to the attached drawing figures, wherein.

DETAILED DESCRIPTION

Figure 1:
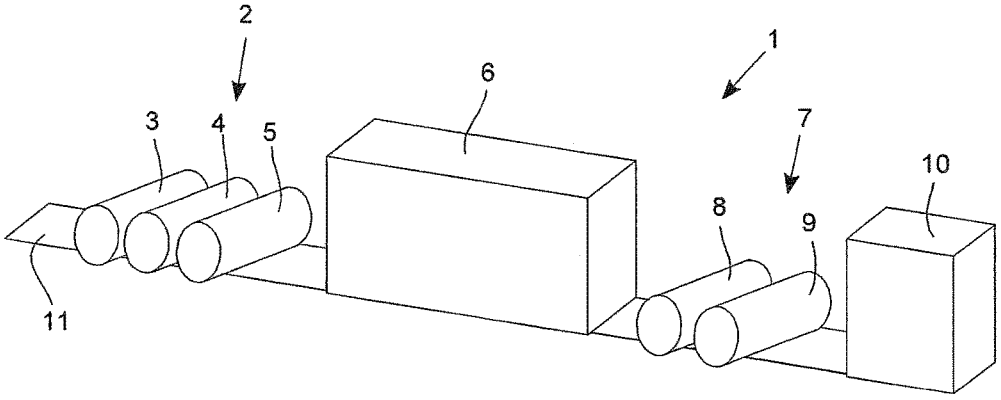
FIG. 1 is an schematic isometric view of an embodiment of a hot-forming apparatus of the present disclosure.

One object of the present disclosure is to permit a faster method sequence for producing a press-hardened shaped component from a blank and at the same time reduce a reject rate.

The object is achieved by means of a hot-forming apparatus for producing a press-hardened shaped component from a blank, with a furnace for heating the blank and a pressing device for forming and cooling the blank heated in the furnace, wherein the hot-forming apparatus has, arranged upstream of the furnace, a preheating roll truing device with a temperature-controllable roller for straightening and preheating the blank.

Further suggested for achieving the object is a method for producing a press-hardened shaped component from a blank, wherein the blank is heated in a furnace and the heated blank is formed and cooled in a pressing device, and wherein, prior to heating in the furnace, the blank is straightened and preheated by means of a temperature-controllable roller of a preheating roll truing device.

By means of the temperature-controllable roller, the blank can in one method step be straightened and preheated. It is therefore not necessary to provide two separate apparatuses for truing and/or straightening the blank and for preheating the blank. By straightening the blank, it is possible to reduce the chance of the blank exhibiting undesired warping during heating, such that the reject rate is reduced. Preheating reduces the temperature difference by which the blank must be heated in the furnace in order to reach the austenitizing temperature, thus reducing the necessary energy input for heating the blanks in the furnace. A furnace designed as a continuous furnace can be made shorter. Thus, the use of a temperature-controllable roller reduces the reject rate and permits a faster method sequence for producing press-hardened shaped components.

According to one advantageous embodiment, the roller of the preheating roll truing device can be heated. It is possible, via the heatable roller, for heat to be transferred to the blank. The preheating roll truing device can have a heating device by means of which the roller can be heated. Preferably, the roller is electrically heated. The roller can additionally be coolable, such that the blank can optionally be cooled by means of the roller. Cooling the blank can then be advantageous if it is necessary to work in the hot-forming apparatus a blank which is not to be heated to its austenitizing temperature.

Preferably, the preheating roll truing device has multiple rollers whose temperatures can be controlled independently of one another, such that the blank can be brought into contact, in sequence, with different temperature-controlled rollers. The different temperature-controllable rollers can be used to predefine a temperature profile. By choosing a suitable temperature profile, it is possible to influence the heating behaviour of the blank and thus the quality of the press-hardened shaped component.

It has further been shown to be advantageous if the preheating roll truing device comprises at least one roller which has regions whose temperatures can be controlled independently of one another. The regions of the roller can be temperature-controlled in such a manner that the blank can be preheated section-by-section to different temperatures. In that regard, section-by-section selective preheating of the blank can be made possible, whereby it is possible to achieve different end temperatures during the subsequent heating in the furnace. In this manner, is it possible for selected sections of the blank to be heated up to the austenitizing temperature while other sections of the blank are heated just to below the austenitizing temperature, such that it is possible to create different strength values in the shaped component made from the blank. Alternatively, the preheating roll truing device may comprise multiple rollers which are arranged on a common axis of rotation, wherein the temperatures of the rollers can be independently controlled, such that it is also possible to preheat the blank section by section.

A preferred configuration provides that a roller of the preheating roll truing device is designed such that a texture can be applied to the surface of the blank. Predefining a surface texture can make it possible to set the warping behaviour of the blank in the furnace and/or to influence the formation of layers at the surface during heating in the furnace. The roller can for example be designed such that the roughness of the blank can be changed. The roller preferably has a structured, in particular roughened, surface, such that the surface of the blank can be structured or roughened according to the surface of the roller when in contact with the roller.

According to a particularly advantageous configuration, the hot-forming apparatus has, arranged between the furnace and the pressing device, a tempering device with a temperature-controllable roller, by means of which the blank heated in the furnace can be tempered. Influencing the temperature of the blank after heating in the furnace makes it optionally possible to pursue various targets. On one hand, it is possible with the tempering device to homogenize the temperature distribution within the blank. On the other hand, it is possible to control the temperature of the tempering device such that the temperature of the blank exiting from the furnace can be held at a predefined value. Optionally, the blank can be cooled by means of the tempering apparatus in order to ensure that, in the subsequent pressing, the steel does not change from the austenite phase into the martensite phase, such that, in a departure from the above-described hot-forming method, no conventional press-hardening takes place.

Preferably, the roller of the tempering device can be heated and/or cooled. The preheating roll truing device can have a heating device by means of which the roller can be heated. Preferably, the roller is electrically heated. The roller can additionally be coolable, such that the blank can optionally be cooled by means of the roller.

In this context, it is preferable if the tempering device has multiple rollers whose temperatures can be controlled independently of one another. The blank exiting from the furnace can be brought into contact, in sequence, with differently temperature-controlled rollers, such that it is possible to predefine a temperature profile. By predefining a suitable temperature profile, it is possible to influence the quality of the press-hardened shaped component.

Particular preference is given to a configuration in which the tempering device comprises at least one roller which has regions whose temperatures can be controlled independently of one another. Similar to that which has already been described in the context of the roller of the preheating roll truing device, the regions of the roller can be temperature-controlled such that the end temperature of the blank during pressing is different section by section. In that context, a section-by-section selective heating of the plate can be made possible. It is thus possible for selected sections of the blank to be heated up to the austenitizing temperature while other sections of the blank are heated only to below the austenitizing temperature, such that different strength values can result in the shaped component made from the blank. Alternatively, the preheating roll truing device can have multiple rollers which are arranged on a common axis of rotation, wherein the temperature of the rollers can be independently controlled, such that it is also possible to achieve, section-by-section, different end temperatures of the blank.

It is further preferable if a roller of the tempering device is designed such that a texture can be applied to the surface of the heated blank. The roller can for example be designed such that it is possible to change the roughness of the blank. For example, it is possible to reduce the roughness of the surface of the blank, in particular to even out surface pores, in order to be able to achieve an improved abrasion behaviour in the subsequent pressing in the pressing device. Alternatively or additionally, providing a texture on the surface of the blank makes it possible to influence the surface appearance of the press-hardened shaped component. Preferably, the roller has a structured, in particular roughened, surface, such that the surface of the blank can be structured and/or roughened upon contact with the roller, depending on the surface of the roller.

Further details, features and advantages of the invention emerge from the drawings and from the following description of preferred embodiments with reference to the drawings. In that context, the drawings illustrate merely exemplary embodiments of the invention which do not restrict the concept of the invention.

FIG. 1 shows a first exemplary embodiment of a hot-forming apparatus 1 according to the invention. The hot-forming apparatus 1 is used for the production of press-hardened shaped components for motor vehicles, for example vehicle doors, side-impact supports, a-pillars or b-pillars. The press-hardening in the hot-forming apparatus 1 generates three-dimensional shaped parts which have increased strength.

The hot-forming apparatus 1 is supplied, as starting material, with flat blanks made of steel sheet, for example made of a manganese-boron-steel sheet, which are worked in the hot-forming apparatus 1 to give three-dimensional press-hardened shaped components. The blanks are obtained by cutting from a coil and can be of a shape that corresponds to the two-dimensional basic shape of the shaped component to be produced.

The blanks are conveyed on a conveying installation 11 through the hot-forming apparatus 1. For heating the blanks, the hot-forming apparatus 1 has a furnace 6 which is designed as a continuous furnace. In the furnace 6, the blanks are heated as they are conveyed through the furnace 6. In the furnace, the blanks reach their austenitizing temperature, which is usually in the range from 700° C. to 1000° C. In order to achieve reliable austenitizing of the blank, it is possible to exceed the austenitizing temperature of the blank material in the furnace.

The heated blanks exit from the end of the furnace 6 and are then fed to a pressing device 10 in which the actual shaping process takes place. In the pressing device 10, the blanks are pressed and simultaneously rapidly cooled in a water-cooled tool, such that the pressed shaped component is quenched. The cooling sets a material temperature in the range from 150° C. to 250° C. The rapid cooling causes the formation of a martensitic lattice structure which is stronger than the starting material.

The blanks fed to the hot-forming apparatus 1 often have deformations and unevennesses which are caused by cutting from the coil. The cutting can release stresses in the material which, in the end, lead to the respective blank being uneven. During heating in the furnace 6, such unevennesses can increase and, in the end, lead to it being impossible for the blank to be correctly introduced into the pressing device 10, such that the blank must be removed from the method as a reject.

In order to eliminate unevennesses and/or deformations present in the blanks, the blanks are fed to a preheating roll truing device 2 prior to introduction into the furnace 6. The preheating roll truing device 2, arranged upstream of the furnace 6 in the material flow direction, has a roller 3 by means of which the blank is straightened, such that its unevenness is reduced after passing through the preheating roll truing device 2. In that context, the roller 3 carries out a roll truing procedure. The roller 3 is also designed so as to be temperature-controllable, such that the blank is also temperature-controlled at the same time as it is trued and/or straightened. In this exemplary embodiment, the roller 3 is heated such that the blank is preheated to a preheat temperature below the austenitizing temperature. The fact that the blank is introduced into the furnace 6 at the preheat temperature reduces the temperature difference which must be provided in the furnace 6 in order to reach the austenitizing temperature. The necessary energy input for heating the blanks in the furnace 6 is reduced. In the case of the furnace 6 of the exemplary embodiment, which is designed as a continuous furnace, this carries the advantage that the length of the furnace 6 can be reduced, such that a compact configuration of the hot-forming apparatus 1 is made possible.

The preheating roll truing device 2 has, in addition to the roller 3, further rollers 4, 5 which are arranged parallel to the roller 3 and which are also temperature-controllable, in particular heatable.

The figures show a schematic representation of the preheating roll truing device 2, showing in each case only rollers 3, 4, 5 which act on the blank from above. In addition to the represented rollers 3, 4, 5, the preheating roll truing device 2 can have further rollers, which act on the blank from below. The rollers acting on the blank from above and from below can be arranged as roller pairs of counter-rotating rollers, for example in the manner of a twin roller stand. In that context, the rollers 3, 4, 5 are preferably part of a roller pair consisting of two counter-rotating rollers. Alternatively or additionally, the rollers of roller pairs acting on the blank from above and from below can be offset with respect to one another in the conveying direction of the blank, such that the rollers act on the blank alternately from above and from below, in order to true the blank and to control the temperature thereof.

The rollers 3, 4, 5 of the preheating roll truing device 2 are independently temperature-controllable, such that each roller 3, 4, 5 can adopt an individual temperature. Since the blank comes into contact with the rollers 3, 4, 5 in succession, it is possible, by virtue of the different temperature controls of the individual rollers 3, 4, 5, to predefine a temperature profile when preheating the blank.

The rollers 4, 5 have a structured surface by means of which the surface of the blank can be worked when in contact with the rollers 4, 5. In that context, the surface of the blanks is conditioned by means of the rollers 4, 5 in order to achieve an advantageous heating behaviour in the furnace 6 and/or an advantageous formation of layers on the surface of the blank. The roughness of the blanks is changed in the preheating roll truing device 2. In a departure from the exemplary embodiment it is possible, alternatively or additionally, for the front roller 3 to be designed such that a texture can be applied to the surface of the blank.

As can further be seen from the representation in FIG. 1, the hot-forming apparatus 1 has a tempering device 7 arranged between the furnace 6 and the pressing device 10 as seen in the material flow direction. The tempering device 7 comprises at least one, preferably multiple rollers 8, 9 which are designed to be temperature-controllable. The tempering device 7 makes it possible for the blank already heated in the furnace to be reheated, such that the temperature of the blank can be held at a predefined end temperature, for example above the austenitizing temperature. In addition, the rollers 8, 9 of the tempering device 7 thus contribute to homogenizing the temperature distribution within the blank.

The figures show a schematic representation of the tempering device 7, showing in each case only rollers 8, 9 which act on the blank from above. In addition to the represented rollers 8, 9, the tempering device 7 can have further rollers which act on the blank from below. The rollers acting on the blank from above and from below can be arranged as roller pairs of counter-rotating rollers, for example in the manner of a twin roller stand. In that context, the rollers 8, 9 are preferably part of a roller pair consisting of two counter-rotating rollers.

The rollers 8, 9 of the tempering apparatus 7 are mutually independently temperature-controllable, such that the blank which has left the furnace is brought into contact in succession with independently temperature-controlled rollers 8, 9. The blank is subjected to a temperature profile by means of which the quality of the press-hardened shaped component can be positively influenced.

In addition, the rollers 8, 9 are designed such that it is possible to apply a texture to the surface of the heated blank. By means of the rollers 8, 9, pores on the surface of the blank are evened out, such that an improved abrasion behaviour is achieved in the subsequent pressing procedure in the pressing device 10. In that respect, the rollers 8, 9 reduce the roughness of the blank, which brings with it the additional advantage of a more appealing surface appearance of the press-hardened shaped component.

Figure 2:
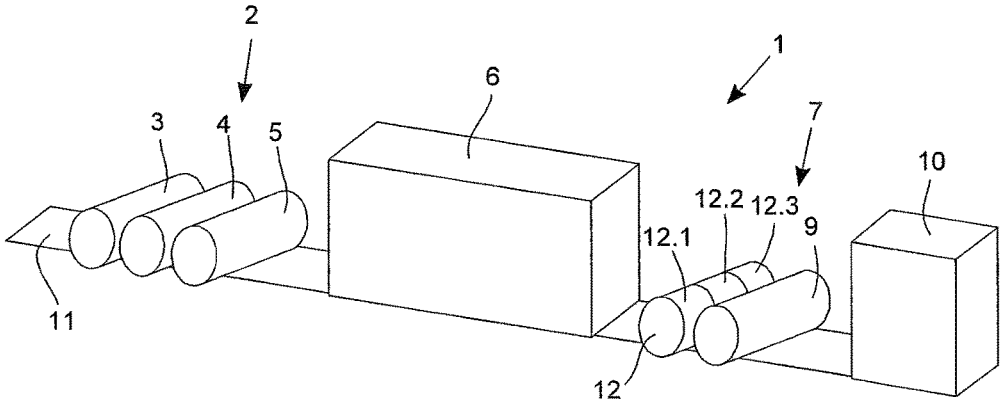
FIG. 2 is schematic isometric view of an alternate embodiment of a hot-forming apparatus of the present disclosure.

FIG. 2 shows a second exemplary embodiment of a hot-forming apparatus 1 according to the invention, which is essentially similar in construction to the hot-forming apparatus 1 of the first exemplary embodiment.

In contrast to the first exemplary embodiment, there is provided in the hot-forming apparatus according to FIG. 2 a tempering device 7 which has a roller 12 that comprises multiple mutually independently temperature-controllable regions 12.1, 12.2, 12.3. In the exemplary embodiment, the outer regions 12.1 and 12.3 of the roller 12 are temperature-controlled such that they are at a lower temperature than the central region 12.2. Due to the different temperature-control of the regions 12.1, 12.2, 12.3, the blank is differently tempered section-by-section when passing through the tempering device 7. Thus, different end temperatures are achieved section-by-section when pressing the blank. In this manner, selected sections of the blank are heated to the austenitizing temperature, while other sections of the blank are heated only to below the austenitizing temperature, such that, after pressing, there result different strength values in the shaped component made from the blank.

In one exemplary embodiment not shown in the figures, the preheating roll truing device 2 has a roller which comprises multiple mutually independently temperature-controllable regions. Just as described above in the context of the roller 12 of the tempering apparatus 7, the regions of this roller can be temperature-controlled such that the blank is preheated section-by-section to different temperatures. Thus, section-by-section selective preheating of the blank can be made possible, whereby it is possible to achieve different end temperatures during the subsequent heating in the furnace 6.

The above-described hot-forming apparatuses 1 for producing a press-hardened shaped component from a blank have a furnace 6 for heating the blank and a pressing device 10 for forming and cooling the blank heated in the furnace 6. Arranged upstream of the furnace 6 is a preheating roll truing device 2 which has a temperature-controllable roller 3, 4, 5 for straightening and preheating the blank. In the above-described method for producing a press-hardened shaped component from a blank, the blank is heated in a furnace 6 and the heated blank is then formed and cooled in a pressing device 10. Prior to heating in the furnace 6, the blank is straightened and preheated by means of a temperature-controllable roller 3, 4, 5 of a preheating roll truing device 2. This reduces the reject rate and makes a faster method sequence possible.

What is claimed is:

1. A hot-forming apparatus for producing a press-hardened shaped component from a blank, the hot-forming apparatus comprising:

a preheating roll truing device having at least one temperature-controllable roller configured to straighten and preheat the blank;

a furnace in operative communication with and disposed downstream of said preheating roll truing device that is configured to heat the blank;

a pressing device in operative communication with and disposed downstream of said furnace that is configured to form and cool the blank heated in said furnace; and a tempering device disposed downstream of the furnace and upstream of the pressing device, the tempering device including a plurality of temperature-controllable rollers configured to temper the blank to a temperature above an austenitizing temperature of the blank, wherein the respective temperature of each roller of the tempering device can be controlled independently of the other rollers.

2. The hot-forming apparatus of claim 1, wherein said at least one roller of the preheating roll truing device is configured to be heated, wherein the at least one roller of the preheating roll truing device is heated in a way that keeps the temperature of the blank below the austenitizing temperature of the blank.

3. The hot-forming apparatus of claim 1, wherein said preheating roll truing device includes a plurality of rollers whose temperatures can be controlled independently of each other.

4. The hot-forming apparatus of claim 1, wherein said preheating roll truing device further includes at least one roller having regions whose temperatures can be controlled independently of each other.

5. The hot-forming apparatus of claim 1, wherein said at least one roller of said preheating roll truing device is configured to apply a texture to a surface of the blank.

6. The hot-forming apparatus of claim 1, wherein at least one of the plurality of temperature-controllable rollers of the tempering device is configured to apply a texture to a surface of the heated blank.

7. A hot-forming apparatus for producing a press-hardened shaped component from a blank, the hot-forming apparatus comprising:

a preheating roll truing device having at least one temperature-controllable roller configured to straighten and preheat the blank;

a furnace in operative communication with and disposed downstream of said preheating roll truing device that is configured to heat the blank;

a pressing device in operative communication with and disposed downstream of said furnace that is configured to form and cool the blank heated in said furnace; and a tempering device disposed downstream of the furnace and upstream of the pressing device, the tempering device including at least one temperature-controllable roller configured to temper the blank to a temperature above an austenitizing temperature of the blank;

wherein the at least one temperature-controllable roller of said tempering device has a plurality of regions whose temperatures can be controlled independently of each other.

8. A method for producing a press-hardened shaped component from a blank, the method comprising:

straightening the blank with a temperature-controllable roller of a preheating roll truing device;

preheating the blank with the temperature-controllable roller of the preheating roll truing device;

heating the blank in a furnace;

tempering the heated blank with a plurality of temperature-controllable rollers of a tempering device to a temperature above an austenitizing temperature of the blank, wherein the respective temperature of each of the plurality of rollers of the tempering device can be controlled independently of the other rollers; and forming and cooling the heated blank in a pressing device.

9. A method for producing a press-hardened shaped component from a blank, the method comprising:

straightening the blank with a temperature-controllable roller of a preheating roll truing device;

preheating the blank with the temperature-controllable roller of the preheating roll truing device;

heating the blank in a furnace;

tempering the heated blank with at least one temperature-controllable roller of a tempering device to a temperature above an austenitizing temperature of the blank; and forming and cooling the heated blank in a pressing device;

wherein the at least one temperature-controllable roller of the tempering device has a plurality of regions whose temperatures can be controlled independently of each other.

10. A method for producing a press-hardened shaped component from a blank, the method comprising:

straightening the blank with a first temperature-controllable roller of a preheating roll truing device;

preheating the blank with a second temperature-controllable roller of the preheating roll truing device in a way that keeps a temperature of the blank below an austenitizing temperature of the blank;

heating the blank in a furnace;

tempering the heated blank with a plurality of temperature-controllable rollers of a tempering device, wherein the respective temperature of each roller of the tempering device can be controlled independently of the other rollers; and forming and cooling the heated blank in a pressing device.

11. A method for producing a press-hardened shaped component from a blank, the method comprising:

straightening the blank with a first temperature-controllable roller of a preheating roll truing device;

preheating the blank with a second temperature-controllable roller of the preheating roll truing device in a way that keeps a temperature of the blank below an austenitizing temperature of the blank;

heating the blank in a furnace;

tempering the heated blank with at least one temperature-controllable roller of a tempering device; and forming and cooling the heated blank in a pressing device;

wherein the at least one temperature-controllable roller of the tempering device has a plurality of regions whose temperatures can be controlled independently of each other.

* * * * *